United States Patent [19]

Berner

[11] Patent Number: 4,939,876

[45] Date of Patent: Jul. 10, 1990

[54] POSITION ADJUSTABLE HANDRAIL FOR USE ALONG STAIRWAYS

[76] Inventor: John M. Berner, 4927 St. Croix Ave., Golden Valley, Minn. 55422

[21] Appl. No.: 327,257

[22] Filed: Mar. 22, 1989

Related U.S. Application Data

[62] Division of Ser. No. 220,325, Jul. 18, 1988, Pat. No. 4,856,761.

[51] Int. Cl.[5] ..... E04F 11/00

[52] U.S. Cl. ..... 52/64; 52/183; 182/113

[58] Field of Search ..... 182/82, 113, 152, 187; 256/59, 65, 67; 52/64, 182–184, 690, 645

[56] References Cited

U.S. PATENT DOCUMENTS

| | | | |
|---|---|---|---|
| 441,072 | 11/1890 | Price . | |
| 937,710 | 10/1909 | Mowrey | 52/183 |
| 1,734,664 | 11/1929 | Albach . | |
| 2,414,538 | 1/1947 | Lamb | 182/113 |
| 2,812,010 | 11/1957 | Abdallah | 155/23 |
| 3,005,623 | 10/1961 | Kusel | 256/67 |
| 3,184,232 | 5/1965 | Nissen | 272/63 |
| 3,331,467 | 7/1967 | Blum et al. | 52/182 X |
| 3,463,457 | 8/1969 | Alexander | 256/59 |
| 3,534,955 | 10/1970 | Wieland | 272/63 |
| 3,964,215 | 6/1976 | Hartman et al. | 52/9 |
| 3,995,832 | 12/1976 | Wiese | 256/59 |
| 4,083,535 | 4/1978 | Britt | 256/24 |
| 4,193,229 | 3/1980 | Hartman | 256/67 X |
| 4,261,550 | 4/1981 | Gregory | 256/67 |
| 4,403,767 | 9/1983 | Basey | 256/67 X |
| 4,673,060 | 6/1987 | Gregory | 182/152 X |

*Primary Examiner*—Carl D. Friedman

*Attorney, Agent, or Firm*—Kinney & Lange

[57] ABSTRACT

A handrail positioning apparatus for use along a stairway is disclosed. The apparatus provides a pivot support fixed to a wall or other support structure to allow positioning of a handrail at at least two different laterally displaced positions. One position can be provided so that the positionable handrail is as close as 22 inches from a second, fixed position handrail disposed opposite the positionable handrail along the stairway. A second position of the handrail occurs in a vertically folded position of the pivoting apparatus bringing the handrail into a position substantially adjacent the support structure, which opens the stairway to about its full width.

10 Claims, 2 Drawing Sheets

POSITION ADJUSTABLE HANDRAIL FOR USE ALONG STAIRWAYS

This is a division of application Ser. No. 07/220,325, filed Jul. 18, 1988 now U.S. Pat. No. 4,856,761.

BACKGROUND OF THE INVENTION

1. Field of the Invention

The invention relates to structures aiding handicapped mobility within buildings and more particularly to a positionable handrail for use along stairwells in buildings.

2. Description of the Prior Art

Older people and those who are movement impaired often encounter difficulty climbing and descending stairs. Movement impaired individuals frequently place both hands on one handrail and creep up or down the stairway in a sidewise or crab-like fashion. Unfortunately, this deliberate motion adds to difficulties in moving up and down the stairs in that it is an unnatural way of walking and impairs the individual's ability to see where they are placing their feet.

In addition, should the person lose their balance, they will find themselves pivoting around the point on the rail on which they have placed their hands making it more difficult for the person to break or otherwise catch their fall.

The most common solution to this problem is to provide a long, gently sloped ramp for such people to walk up. However, many buildings, including particularly multi-story homes where many movement impaired individuals live, are not easily modified to accommodate ramps.

SUMMARY OF THE INVENTION

The present invention provides a handrail support system for use along a stairway. The support system includes a pair of parallel handrails disposed opposite one anOther along the stairway. At least one of the pair of handrails is laterally positionable into the course Of the stairway by provision of a handrail positioning structure.

The handrail positioning structure includes a lower pivot secured to a preexisting support structure or wall disposed along one side of the stairway. The lower pivot supports a strut mechanism which is pivotable on the pivot in a plane perpendicular into and out of the wall. The handrail is supported on the outer end of the strut structure away from the pivoted end. An upper pivot is also provided fixed to the wall above the lower pivot. A retaining arm structure is pivotally mounted at its inner end on the pivot structure and carries a retaining brace on its outer end. The strut structure carries a support beam which is urged against the retaining arms as the strut structure rotates away from the wall and out into the stairway. Movement of the strut structure thus causes the retaining arms also to rotate out into the stairway bringing the retaining brace into contact with the strut structure to prevent its pivoting outward beyond a certain maximum position. Appropriate disposition of the retaining brace and support beam provide a position of the handrail at a desired point for grasping by an individual user. This position is determined by a desired distance between the positionable handrail and a fixed handrail so that the intended user can easily grasp and support themself between the two handrails when navigating a stairway.

DETAILED DESCRIPTION OF THE PREFERRED EMBODIMENTS

Figure 1:
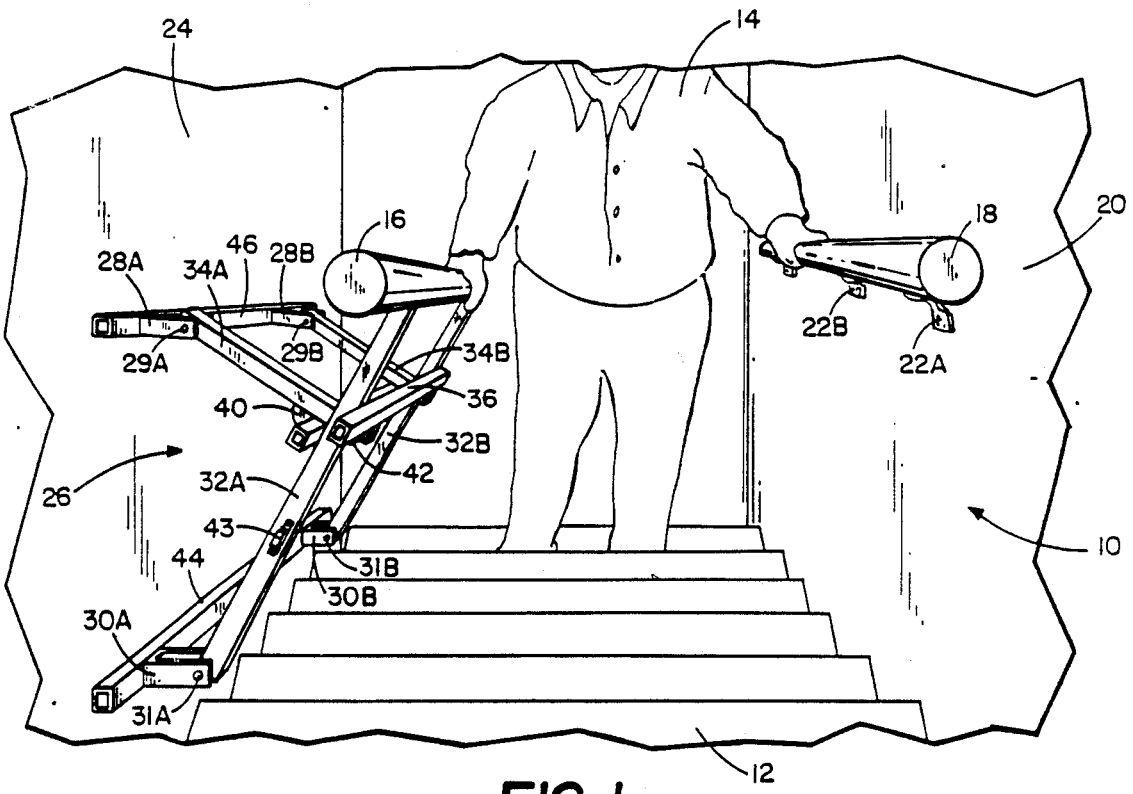
FIG. 1 is a perspective view of a handrail support system disposed along a stairway.

FIG. 1 illustrates a handrail support system 10 disposed along the stairway 12 for use by an infirm or elderly individual 14. Infirm individual 14 supports himself between appropriately spaced handrails 16 and 18 while ascending (or descending) stairway 12.

Handrail 18 is mounted on wall 20 by conventional supports 22A and 22B which are fastened to wall 20 by appropriate fasteners. Handrail 16 is supported on wall 24 by a handrail positioning structure 26. Handrail positioning structure 26 is attached to wall 24 along wall mounts 44 and 46. Wall mount 46 includes hinges 28A and 28B while wall mount 44 includes hinges 30A and 30B, respectively. Upper hinges 28A and 28B have coaxial pins 29A and 29B defining an upper pivot axis while hinges 30A and 30B have coaxial pins 31A and 31B, respectively, defining a lower pivot axis. The pivot axes defined by 29A with 29B and 31A with 31B are parallel and are substantially aligned with the incline of stairway 12. Handrails 16 and 18 can be extended beyond the incline of the stairway out over floors both at the foot and the head of stairway 12. This allows infirm individual 14 to firmly grasp rails 16 and 18 before beginning his or her ascent or descent.

Struts 32A and 32B are pivotally mounted at their inner ends on pins 31A and 318 set in hinges 30A and 30B, respectively. Handrail 16 is mounted at the outer ends of struts 32A and 32B, respectively.

Retaining arms 34A and 34B are pivotally mounted on pins 29A and 29B, which are set in hinges 28A and 28B. A retaining brace 36 is mounted on the outer end of retaining arms 34A and 34B, against which struts 32A and 32B rest when pivoted to their maximally pivoted position into stairway 12. A support beam 38 is mounted on struts 32A and 32B in parallel with retaining brace 36. Support beam 38 is positioned to ride along the relative underside of retaining arms 34A and 34B so that when struts 32A and 32B are pivoted outward over stairway 12, support beam 38 is urged against retaining arms 34A and 34B causing the retaining arms to rotate outward from wall 24 eventually bringing retaining brace 36 into contact with struts 32A and 32B to resist further rotation. A locking mechanism 40 is disposed on arms 34A and 34B for positioning against support beam 38 to lock the position of positioning structure 26.

A magnet 42 is disposed on one face of retaining brace 36, and a magnetically attractable latch 43 is mounted on struct 32A, for purposes set forth hereinafter. Depending upon the gap between walls 20 and 24 on either side of stairwell 12, handrails 16 and 18 may be positioned conveniently at between 22 and 26 inches apart when positioning structure 26 is extended.

Figure 3A:
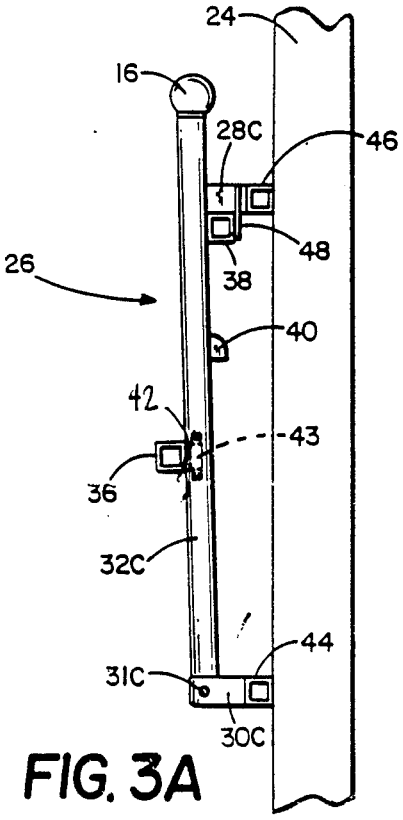
FIGS. 3A and 3B are end views of the positioning apparatus in its folded vertical orientation and in its maximally pivoted position.
Figure 2:
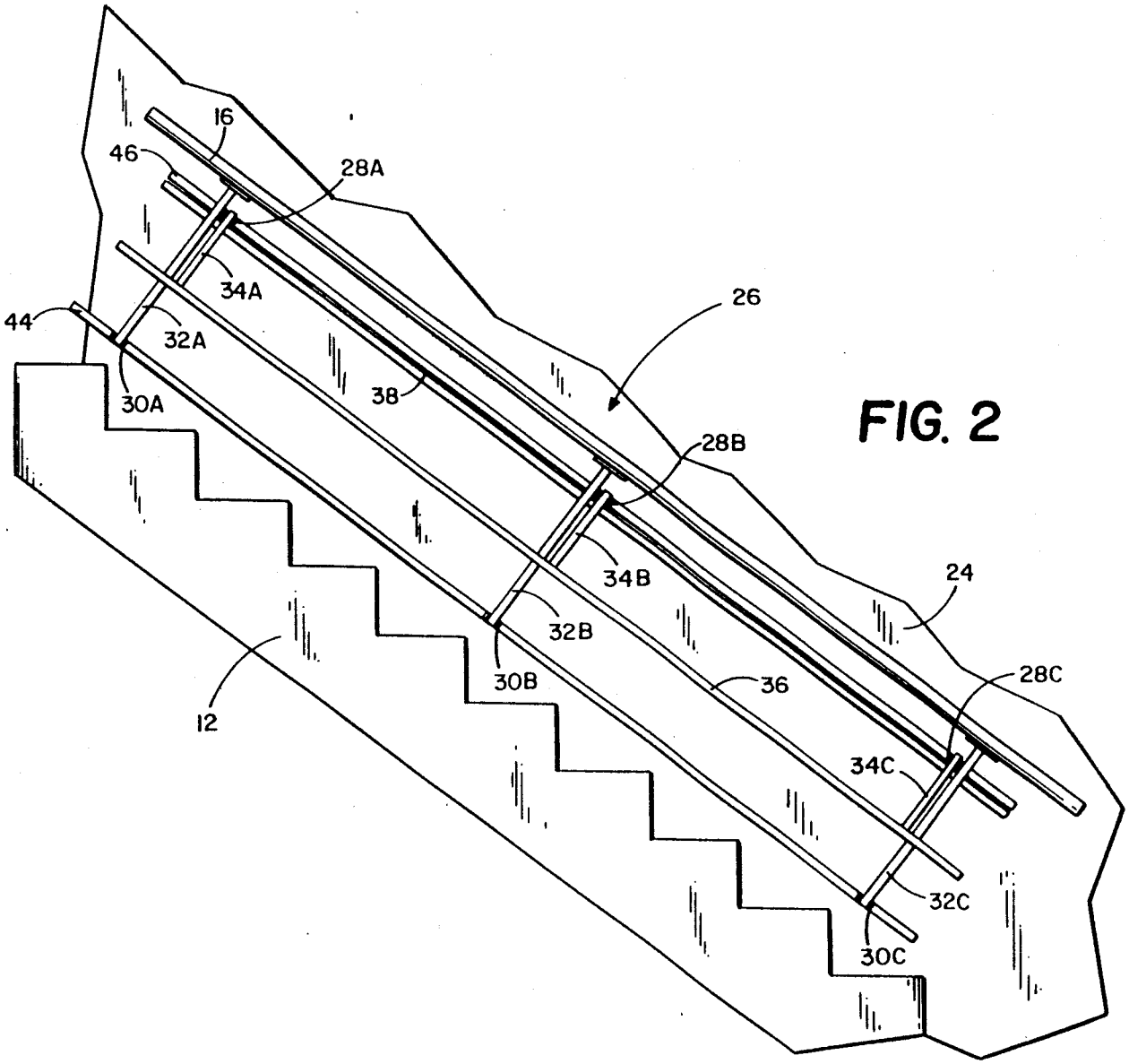
FIG. 2 is a side view of the handrail positioning apparatus of the present invention.

FIG. 2 illustrates handrail positioning structure 26 folded into an upright position along wall 24. Structure 26 shown in FIG. 2 is similar to that shown in FIG. 1, except that it is longer and, therefore, has an additional strut 32C, retaining arm 34C, pivot 28C and pivot 30C. Wall mounts 44 and 46 are secured to wall 26 substantially in parallel with the incline of stairway 18. Pivots 30A, 30B, 30C are coaxial with the pivot axis and aligned with wall mount 44. Similarly, pivots 28A, 28B and 28C are coaxial with the pivot axis and aligned with wall mount 46. Retaining arms 34A through 34C hang vertically from pivots 28A–28C with retaining brace 36 below pivots 28A through 28C Struts 32A–32C are supported disposed vertically from pivots 30A–30C with handrail 16 above both pivots 30A–30C as well as pivots 28A–28C. So positioned, handrail 16 may be used as a conventional handrail. Magnets 42 disposed on retaining brace 36 engage and hold latches 43 (as shown in FIG. 3A) and keep positioning structure 26 in an upright position preventing unintended unfolding of the structure. The vertically oriented position of positioning structure 26 is provided so that handrail 16 may be pushed up and out of the way when inconvenient for the movement of furniture or other objects by way of stairway 18. Those skilled in the art will realize that the number of struts 32 and retaining arms 34 can be increased or decreased as required by the length of the handrail.

Figure 3B:
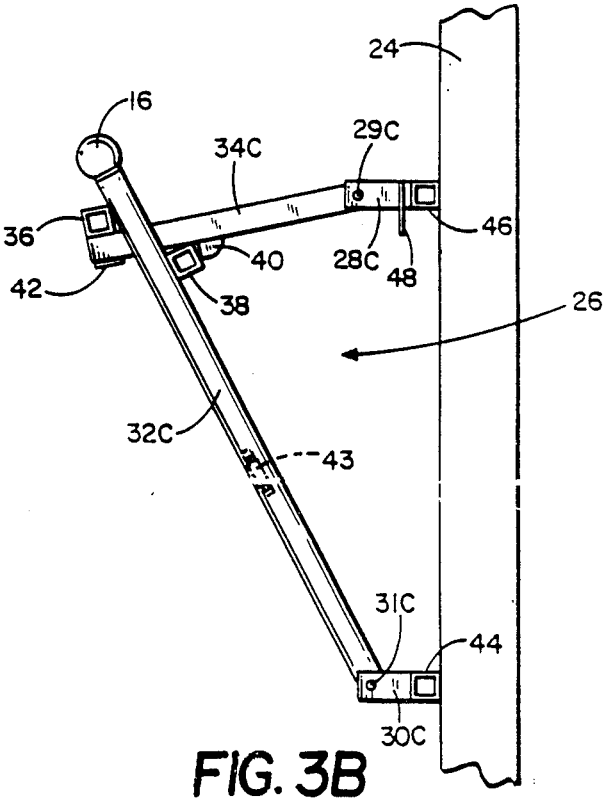

FIGS. 3A and 3B illustrate from end views the upright position and maximally pivoted position of positioning structure 26. FIG. 3A illustrates handrail positioning structure 26 compactly folded into the upright position along support wall 24. Strut 32C is disposed in the maximally upright position on hinge 30C which depends from wall mount 44. Retaining brace 36 carries a magnet 42 which is in contact with latch 43 mounted on strut 32C for preventing unintended rotation of strut 32C. Retaining brace 36 is attached to the outer end of retaining arm 34 (seen in FIG. 3B). Support beam 38, which is mounted on strut 32C, abuts a retaining plate 48 preventing rotation of strut 32C toward a wall 24. Handrail 16 is accordingly positioned relatively closely but at an easily grasped distance out from wall 24.

FIG. 3B illustrates support structure 26 with strut 32C in the maximally pivoted position outward from wall 24. Strut 32C and retaining arm 34C are essentially pinched between retaining brace 36 and support beam 38. To further secure positioning structure 26 against movement under load, a downwardly protruding hook 40 is provided on each retaining arm including retaining arm 34C which fixes the position of support beam 38. Retaining arm 34C has been rotated outward and into the stairway on pivot 29C, which is fixed in hinged 28C. Strut 32C is rotated outward and downward on pin 31C mounted in hinge 30C from wall 26. Handrail 16 is accordingly positioned at a spaced distance from wall 24 relative to its position in the vertically oriented position depicted in FIG. 3A.

The present invention provides for preserving the mobility of older people and others who are infirm within their own homes. By allowing the elderly to use stairs, the system provides an excellent form of exercise while at the same time helping to prevent injuries. Depending on configuration of the positioning structure, a handrail is provided which pivots outward from a stairway wall to provide relatively closely spaced parallel beams for the infirm patient to use when climbing or descending stairs. The positioning of the handrails allows the individual to ascend and descend stairs in a normal front first fashion while providing two points of support should the person need to recover from a slip.

Although the present invention has been described with reference to preferred embodiments, workers skilled in the art will recognize that changes may be made in form and detail without departing from the spirit and scope of the invention.

What is claimed is:

1. A handrail support system for use along a passageway between first and second generally parallel walls comprising:

first and second handrails;

means for positioning the second handrail generally parallel to the second wall; and means for positioning the first handrail in a first locked position generally parallel and substantially adjacent to the first wall and in a second locked position parallel to the first wall and spaced laterally further from said first wall than the first locked position.

2. The handrail support system of claim 1 wherein the first handrail positioning means comprises:

strut means pivotally mounted to the first wall at a first end and attached to the first handrail at a second end; and retaining means for engaging the strut means when the first handrail is in the second locked position.

3. The handrail support system of claim 2 wherein the retaining means are pivotally connected to the wall for pivotal movement between a collapsed position adjacent the wall when the first handrail is in the first locked position and an extended position in which the retaining means engage the strut means when the first handrail is in the second locked position.

4. A handrail support system for use along a passageway or stairway comprising:

first and second handrails;

means for positioning the second handrail along the passageway or stairway; and means for positioning the first handrail in a first locked position generally parallel to the second handrail and spaced therefrom across the passageway or stairway and in a second locked position parallel to the second handrail and closer thereto than in the first locked position.

5. The handrail support system of claim 4 wherein the passageway or stairway is located along a wall and wherein the first handrail positioning means comprises:

strut means pivotally mounted to the wall at a first end and attached to the first handrail at a second end; and retaining means for engaging the strut means when the first handrail is in the second locked position.

6. The handrail support system of claim 5 wherein the retaining means are pivotally connected to the wall for pivotal movement between a collapsed position adjacent the wall when the first handrail is in the first locked position and a second an extended position in which the retaining means engage the strut means when the first handrail is in the second locked position.

7. A handrail support system for use along a passageway between first and second generally parallel walls comprising:

first and second handrails; means for positioning the second handrail generally parallel to the second wall;

strut means pivotally mounted to the first wall at a first end and attached to the first handrail at a second end for positioning the first handrail in a first locked position generally parallel to the first wall and in a second locked position parallel to the first wall and spaced laterally further from said wall and closer to the second handrail than in the first locked position; and retaining means for engaging the strut means when the first handrail is in the second locked position.

8. The handrail support system of claim 7 wherein the retaining means are pivotally connected to the first wall for pivotal movement between a collapsed position adjacent the wall when the first handrail is in the first locked position and an extended position in which the retaining means engage the strut means when the first handrail is in the second locked position.

9. A handrail support system for use along a passageway or stairway located along a wall comprising:

first and second handrails;

means for positioning the second handrail along the passageway or stairway;

strut means pivotally mounted to the wall at a first end and attached to the first handrail at a second end for positioning the first handrail in a first locked position generally parallel to the second handrail and spaced therefrom across the passageway or stairway, and in a second locked position parallel to the second handrail and closer thereto than in the first locked position; and retaining means for engaging the strut means when the first handrail is in the second locked position.

10. The handrail support system of claim 9 wherein the retaining means are pivotally connected to the wall for pivotal movement between a collapsed position adjacent the wall when the first handrail is in the first locked position and a second an extended position in which the retaining means engage the strut means when the first handrail is in the second locked position.

* * * * *

UNITED STATES PATENT AND TRADEMARK OFFICE

CERTIFICATE OF CORRECTION

PATENT NO. : 4,939,876

DATED : July 10, 1990

INVENTOR(S) : John M. Berner

It is certified that error appears in the above-identified patent and that said Letters Patent is hereby corrected as shown below:

On the title page, after the data in item [76], insert the following:

[*] Notice: The portion of the term of this patent subsequent to Aug. 15, 2006, has been disclaimed.

Signed and Sealed this

Twelfth Day of November, 1991

*Attest:*

HARRY F. MANBECK, JR.

*Attesting Officer*

*Commissioner of Patents and Trademarks*